US006193067B1

(12) United States Patent
McMahan

(10) Patent No.: US 6,193,067 B1
(45) Date of Patent: Feb. 27, 2001

(54) SELF-FRONTING MERCHANDISE DISPLAY BOX

(76) Inventor: Timothy C. McMahan, 2269 Valle Dr., La Habra Heights, CA (US) 90631

( * ) Notice: Subject to any disclaimer, the term of this patent is extended or adjusted under 35 U.S.C. 154(b) by 0 days.

(21) Appl. No.: 09/389,608

(22) Filed: Sep. 3, 1999

(51) Int. Cl.[7] ..... B65D 6/04
(52) U.S. Cl. ..... 206/560; 206/805; 206/565
(58) Field of Search ..... 206/805, 761, 206/45.29, 478, 565, 562, 560, 817; 211/50, 51

(56) References Cited

U.S. PATENT DOCUMENTS 3,561,595 * 2/1971 Malloy ..... 211/49.1
4,699,277 * 10/1987 Baxter ..... 211/51
4,838,436 * 6/1989 Bailey ..... 211/51
5,169,001 * 12/1992 Scheibel ..... 206/425

* cited by examiner

*Primary Examiner*—Paul T. Sewell
*Assistant Examiner*—Shian Luong
(74) *Attorney, Agent, or Firm*—Edgar W. Averill, Jr.

(57) ABSTRACT

A self-fronting merchandise display box. The box has a horizontal bottom, two sides, a back panel and a front panel. A plurality of merchandise containers form a merchandise column within the box. A rubber band is held adjacent the front panel of the box and extends around the back of the merchandise column. As the front merchandise container is lifted upwardly out of the box, the remaining column of merchandise is moved forward by the retraction of the rubber band. Preferably, a follower plate is located behind the rear of the merchandise column.

6 Claims, 1 Drawing Sheet

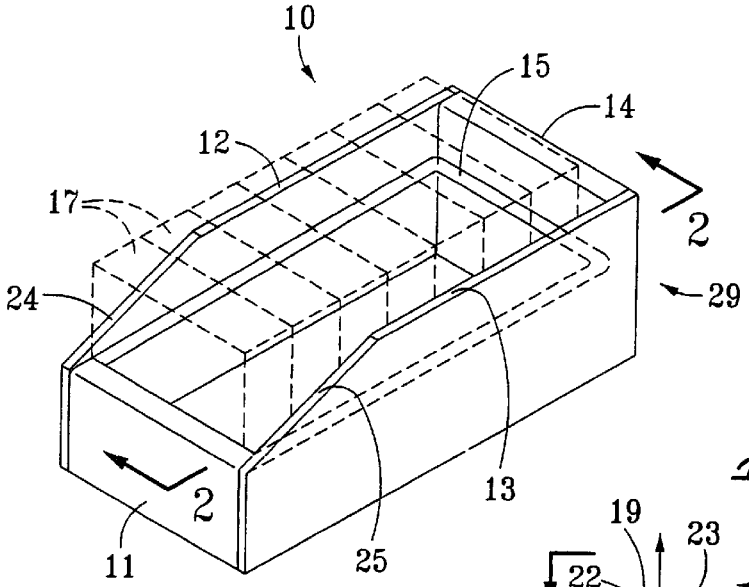
FIG. 1
FIG. 2
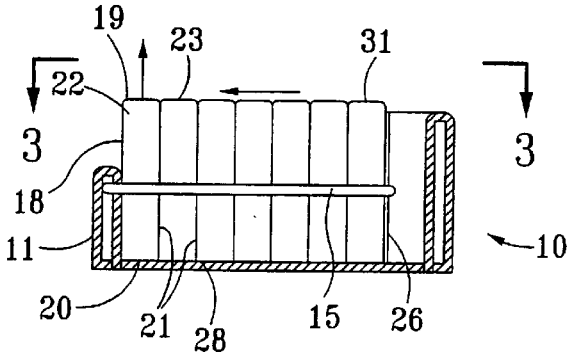
FIG. 3
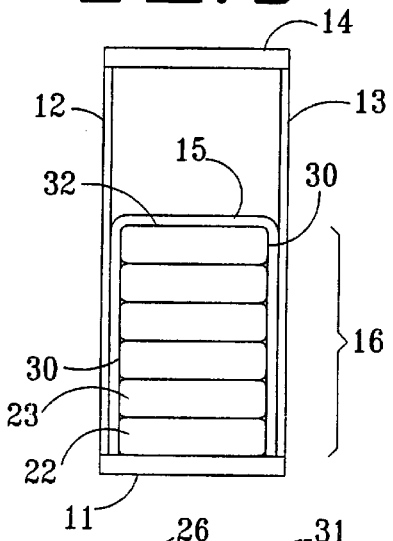
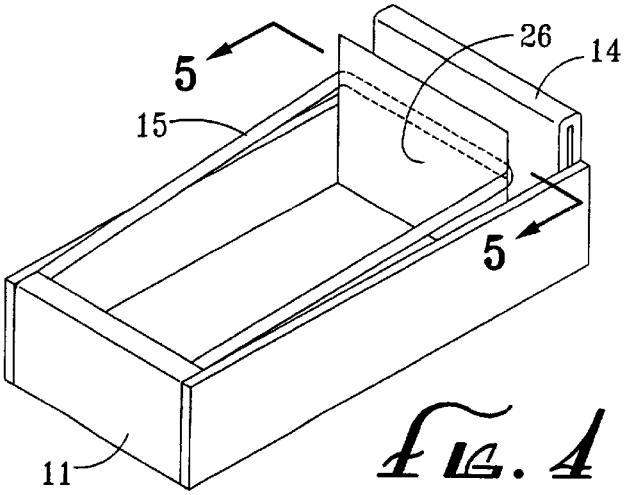
FIG. 4
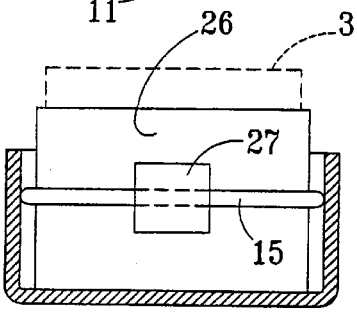
FIG. 5

SELF-FRONTING MERCHANDISE DISPLAY BOX

BACKGROUND OF THE INVENTION

The field of the invention is merchandise packaging and the invention relates more particularly to containers for displaying goods in retail outlets such as supermarkets. While various merchandise containers include a feature of replacing a removed box, such containers are invariably positioned vertically or on a substantial angle to urge a column of merchandise downwardly once the front container has been removed. Such vertical display, however, requires substantially increased shelf space and shelf height. Such space is at a premium in most retail outlets and, thus, replaceable display cases are usually limited to checkout stands where the depth of the display case is already limited.

Various means for refreshing the display of merchandise have been known. An adjustable supporting means for display containers is shown in U.S. Pat. No. 1,616,980. A cigar box is illustrated which moves upwardly when an upper layer of cigars has been removed. The box has an adjustable bottom or follower. Beneath of the lower surface of the follower are three pairs of U-shaped legs of different lengths. After a first layer of merchandise has been removed, ribbons 20 are exposed and are lifted and the shortest U-shaped legs tilt downwardly by gravity and support the follower 12 in a slightly raised position. As the next layer of merchandise is removed, the ribbons are again lifted and a second pair of U-shaped legs fall downwardly to support the follower at a yet higher length. Such a fronting unit operates only when the follower tray is manually lifted and would be inoperative in a horizontal display box.

A self-leveling and storing dispensing apparatus is shown in U.S. Pat. No. 2,828,006. A vertical stack of merchandise is held on a carrier platform which is held by two rubber bands held near the upper opening of the dispensing apparatus. As a box of merchandise is removed from the top of the stack, the stack grows lighter and the rubber bands raise the stack to expose a lower merchandise container. Once again, the merchandise must be vertically stacked for the dispensing apparatus to work.

In U.S. Pat. No. 3,561,595 a rubber band is used to maintain tape cartridge cassettes in a vertical configuration. When the tape cassettes are tilted to observe the labels, the rubber band is stretched. When the cassettes are released, the rubber band returns the cassettes to a vertical configuration.

U.S. Pat. No. 3,858,717 shows a retail store container for perishable foods. When the container is half empty, a tab is pulled forward to move the merchandise to the front of the container. The tab must be manually pulled forward for the container to expose merchandise from the back of the container.

There is a need for a convenient and low-cost self-fronting merchandise display box which automatically moves a merchandise column toward the front when the frontmost merchandise container is removed by a shopper.

BRIEF SUMMARY OF THE INVENTION

It is an object of the present invention to provide a self-fronting merchandise display useful for a box having a horizontal column of merchandise.

The present invention is for a self-fronting merchandise display box. The box has a horizontal bottom, two sides, a back panel and a front panel. A plurality of merchandise containers forming a merchandise column is held within the box. A rubber band is held adjacent the front panel of the box and is stretched to an extended length around the back of the merchandise column. When the front container is lifted out of the box, the remaining containers in the column move forward against the front panel of the box so that a new merchandise container is always maintained adjacent the front of the box and visible to a shopper. Preferably, a follower plate is positioned behind the back of the merchandise column and the rubber band adhered to a back side thereof.

BRIEF DESCRIPTION OF THE DRAWINGS

FIG. 1 is a perspective view of the merchandise box of the present invention showing a column of merchandise in phantom view.

FIG. 2 is a cross-sectional side view taken along line 2—2 of FIG. 1, but showing the merchandise column.

FIG. 3 is a top view of the box and merchandise column of FIG. 2.

FIG. 4 is a perspective view of the box of FIG. 1 further including a follower plate.

FIG. 5 is a view taken along line 5—5 of FIG. 4 showing the back of the follower plate.

DESCRIPTION OF THE PREFERRED EMBODIMENTS

A merchandise box assembly including a self-fronting feature is shown in perspective view in FIG. 1 and indicated generally by reference character 10. Box portion 29 of merchandise box assembly 10 has a front panel 11, a first side 12, a second side 13 and a back panel 14. A rubber band 15 is folded into front panel 11 along a portion thereof and is stretched so that it extends in a generally rectangular configuration to a position near back panel 14. Rubber band 15 extends behind the back 32 of rear container 31. A merchandise column 16 of merchandise containers 17 is shown in phantom view in FIG. 1 and in full view in FIG. 2.

As shown in FIG. 2, each individual merchandise container 17 has a front face 18, a top 19, a bottom 20, two sides 30 and a back 21. When front container 22 is lifted out of the self-fronting merchandise display box 10, the second container 23 is pulled toward the front until it abuts the front panel 11. The front face 18 is exposed sufficiently to show the nature of the merchandise to a shopper. Preferably, the sides of box 10 are cut downwardly as indicated in FIG. 1 at reference characters 24 and 25 to permit the shopper to grasp the front container 22 from the sides 30.

Also, preferably, a follower plate 26 is affixed to a portion of rubber band 15 as, for instance, by a length of tape 27. Follower plate 26 helps to guide the merchandise column 16 and to maintain the merchandise containers 17 in a vertical position. Preferably, follower plate 26 is slightly wider than the merchandise so the last merchandise container 31 can be lifted out of the box without pulling the rubber band 15 out of the box portion 29.

By utilizing a container with a horizontal bottom 28 without any seams, the merchandise may freely slide along the bottom without any interruption. By utilizing an inwardly folded front panel 11 the rubber band can be easily held against the front panel as shown best in FIG. 2 of the drawings. Preferably, the rubber band is made from crepe rubber which has excellent elastic characteristics.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A merchandise display box assembly (10) comprising:

a box portion (29) having a horizontal bottom (28), two sides (12,13), a back panel (14) and a front panel (11);

a plurality of merchandise containers (17) supported on the horizontal bottom (28) of said box portion (29) forming a merchandise column (16) including a front container (22) and a rear container (31), a portion of said plurality of merchandise containers (17) extending upwardly above said front panel (11) of said box portion (29), said plurality of merchandise containers (17) each having a front face (18) and a back (21), a bottom (20) and a top (19) and two sides (30); and a rubber band (15) held adjacent said front panel (11) and stretchable to an extended length adjacent said back panel (14) of said box portion (29) and said rubber band (15) extending along said two sides (30) of said plurality of merchandise containers (17) and around the back (32) of said rear container (31) and urging said merchandise column (16) toward said front panel (11) whereby when said front container (22) is lifted out of said box portion (29), the remaining containers in the merchandise column (16) move forward against the front panel (11) of the box portion (29) so that a portion of the plurality of merchandise containers (17) is clearly visible on a merchandise shelf and wherein said box portion has an inwardly folded front panel which captures a portion of said rubber band.

2. The merchandise display box assembly of claim 1 wherein said rubber band is a crepe rubber band.

3. The merchandise display box assembly of claim 1 wherein said horizontal bottom of said box portion is free of seams.

4. A merchandise display box assembly (10) comprising:

a box portion (29) having a horizontal bottom (28), two sides (12,13), a back panel (14) and a front panel (11);

a plurality of merchandise containers (17) supported on the horizontal bottom (28) of said box portion (29) forming a merchandise column (16) including a front container (22) and a rear container (31), a portion of said plurality of merchandise containers (17) extending upwardly above said front panel (11) of said box portion (29), said plurality of merchandise containers (17) each having a front face (18) and a back (21), a bottom (20) and a top (19) and two sides (30); and a rubber band (15) held adjacent said front panel (11) and stretchable to an extended length adjacent said back panel (14) of said box portion (29) and said rubber band (15) extending along said two sides (30) of said plurality of merchandise containers (17) and around the back (32) of said rear container (31) and urging said merchandise column (16) toward said front panel (11) whereby when said front container (22) is lifted out of said box portion (29), the remaining containers in the merchandise column (16) move forward against the front panel (11) of the box portion (29) so that a portion of the plurality of merchandise containers (17) is clearly visible on a merchandise shelf and wherein said merchandise display box further includes a follower plate positioned behind the back of a rear container in said merchandise column and wherein a portion of said rubber band extends around the rear surface of said follower plate.

5. The merchandise display box assembly of claim 4 wherein said portion of said rubber band is affixed to the rear surface of said follower plate.

6. The merchandise display box assembly of claim 5 wherein said follower plate is wider than said merchandise column.

* * * * *